United States Patent [19]

Bruno

[11] Patent Number: 4,813,684

[45] Date of Patent: Mar. 21, 1989

[54] TARGET FOR BOW AND ARROW

[76] Inventor: Steven D. Bruno, 1315 Highland Ave., Joliet, Ill. 60435

[21] Appl. No.: 63,938

[22] Filed: Jun. 19, 1987

[51] Int. Cl.[4] ..... F41J 3/00

[52] U.S. Cl. ..... 273/403; 273/408

[58] Field of Search ..... 273/403, 407, 408; 248/457, 474

[56] References Cited

U.S. PATENT DOCUMENTS

| | | | |
|---|---|---|---|
| 1,317,556 | 9/1919 | Cooper | 273/407 X |
| 1,525,339 | 2/1925 | Toohey | 273/407 |
| 1,584,105 | 5/1926 | Lenz | 248/457 |
| 3,512,778 | 5/1970 | Allen | 273/403 |
| 4,138,083 | 2/1979 | Spiegel | 248/474 |
| 4,546,984 | 10/1985 | Towle et al. | 273/407 X |

FOREIGN PATENT DOCUMENTS

| | | | |
|---|---|---|---|
| 123082 | 12/1946 | Australia | 273/408 |
| 358951 | 1/1906 | France | 273/403 |

*Primary Examiner*—Paul E. Shapiro

*Attorney, Agent, or Firm*—Ernest Kettelson

[57] ABSTRACT

A target for bow and arrow, comprising a stack of cardboard strips held within a frame having an upper and lower portion, in which the top wall of the upper portion can be pressed downwardly to compress the strips together. The lower frame member telescopes into the upper frame for a limited distance. The frame is mounted on a stand having wheels and a depending support member to easily move and set up at a desired location. The frame is pivotally mounted on the stand so it can be rotated to place both the front and back of the target facing the archer. The target surface can be rotated and set at any desired angle, such as for shooting from a tree or other elevated position.

5 Claims, 5 Drawing Sheets

TARGET FOR BOW AND ARROW

BACKGROUND OF THE INVENTION

This invention relates to the field of targets for a bow and arrow, and in particular those which are free standing and self contained.

Prior art targets of the free standing, self contained type for archers using a bow and arrow include those disclosed in the following U.S. patents.

U.S. Pat. No. 4,235,444 discloses a target having a plurality of vertically extending spaced apart layers of elastomeric material with porous resilient material between each layer, presenting a substantially solid continuous surface facing toward the archer rather than a stacked plurality of side edges of laterally extending compressed strips of penetrable material.

U.S. Pat. No. 4,195,839 discloses a target having a plurality of plastic rods bundled together in parallel relationship, extending from front to back in a horizontal plane or more horizontal than vertical, with a tapered or pointed front end of each rod facing toward the archer. The back end of each rod has a central recess opening to its end wall to receive a positioning stud for holding each rod in place. This target is supported by a stand which can be adjusted to tilt the face of the target at an oblique angle to the vertical.

U.S. Pat. No. 3,900,778 discloses a target made up of alternating layers of corrugated and smooth sheets of fluted material, spirally wound into a roll with one end facing the archer presenting a target surface of corrugations each having a cross-section smaller than the cross-section of the arrow so the corrugated openings have to stretch when the arrow penetrates therein.

U.S. Pat. No. 3,512,778 discloses a target made up of corrugated cardboard strips which present a honeycomb impact surface facing toward the archer, in which the strips are mutually grooved to provide channels at each side of the impact surface which engage longitudinal projections extending from the sides of the frame.

U.S. Pat. No. 3,329,431 discloses a multi-section archery target of excelsior packets stuffed in a package in layers to make up a rectangular self contained archery target, bounded and compressed together at top and bottom by wooden boards compressed against the excelsior packets by binding cords.

U.S. Pat. No. 3,048,401 discloses an archery target mat of corrugated material spirally wound in a cylindrical roll for placing a target over an end wall of the cylindrical mat which an arrow can penetrate through to lodge in the corrugated material of the mat.

U.S. Pat. No. 1,837,627 discloses an archery target comprising an annular ring of cellular strawboard or paperboard and a replaceable center roll of the same material held in place by dowel pins, the target having a backing strip of material such as basswood, balsa, cork or the like.

As far as the inventor has been able to determine, the prior art targets do not include frames or stands which have wheels for rolling from one location to another, nor do they provide a frame in which ordinary rectangular strips of cardboard can be laid one on top of the other without having their ends specially shaped or cut, without winding into a roll, without use of adhesives to hold one to the other, without alternating strips of one kind with strips of another, and in which the degree of compression of one flat strip against another can be adjusted to increase or decrease the penetrability of an arrow into the target. The target in accordance with the present invention accomplishes all those objectives thereby providing an improvement over known types of archery targets.

SUMMARY OF THE INVENTION

It is an object of the invention to provide an archery target for arrows comprising a stack of laterally extending strips of cardboard or similar porous, fibrous material with the side edges thereof facing toward the archer, the strips being compressed together within a peripherally extending frame which includes adjustment means to increase or decrease the compression of the strips against each other to increase or decrease the penetration of an arrow into and between the edges of the strips.

It is an object of the invention to provide an archery target for arrows comprising a stack of laterally extending strips of cardboard or other similar porous, fibrous material with the sides edges thereof facing toward the archer, including a frame in which like strips of flat, plain, rectangular pieces of such material may be loosely stacked one on top of the other, the frame including a top wall portion which serves as a pressure plate to bear against and compress the strips together to whatever degree of compression desired.

It is an object of the invention to provide an archery target for arrows having a frame supported on wheels or rollers for convenient rolling of the target from one place to another.

It is an object of the invention to provide an archery target for arrows having a frame with adjustable means to vary the angle of the impact surface of the target from the vertical.

DESCRIPTION OF PREFERRED EMBODIMENT

Figure 1:
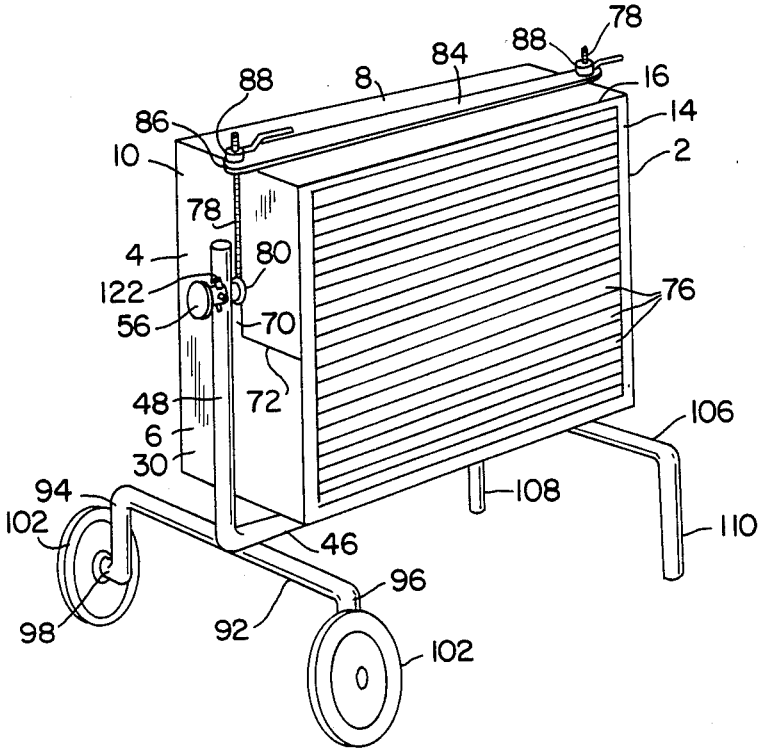
FIG. 1 is a perspective view from the side of an archery target in accordance with this invention.
Figure 2:
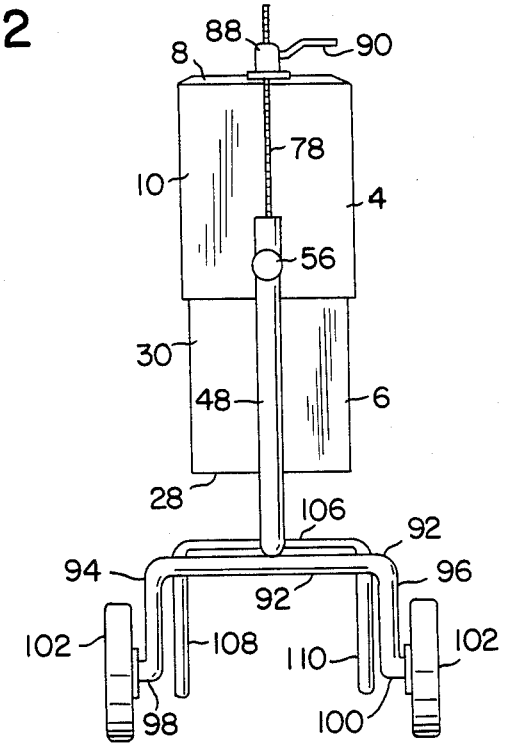
FIG. 2 is a perspective view from one end of the archery target shown in FIG. 1.
Figure 3:
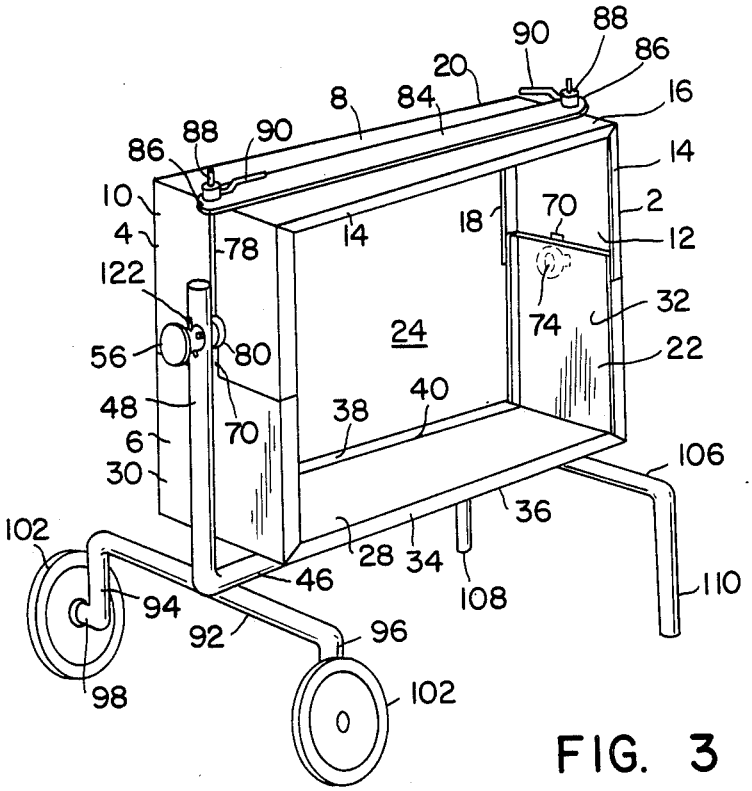
FIG. 3 is a perspective view from the side of an archery target as shown in FIG. 1 but with the cardboard strip inserts removed.
Figure 4:
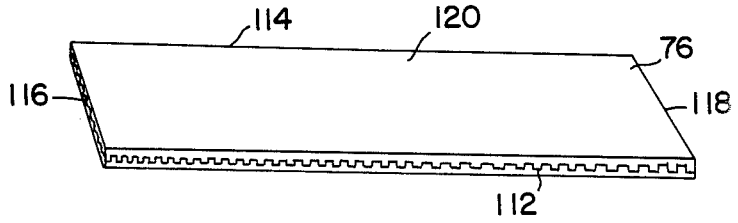
FIG. 4 is a perspective view of a cardboard strip for use in the archery target in accordance with this invention.
Figure 5:
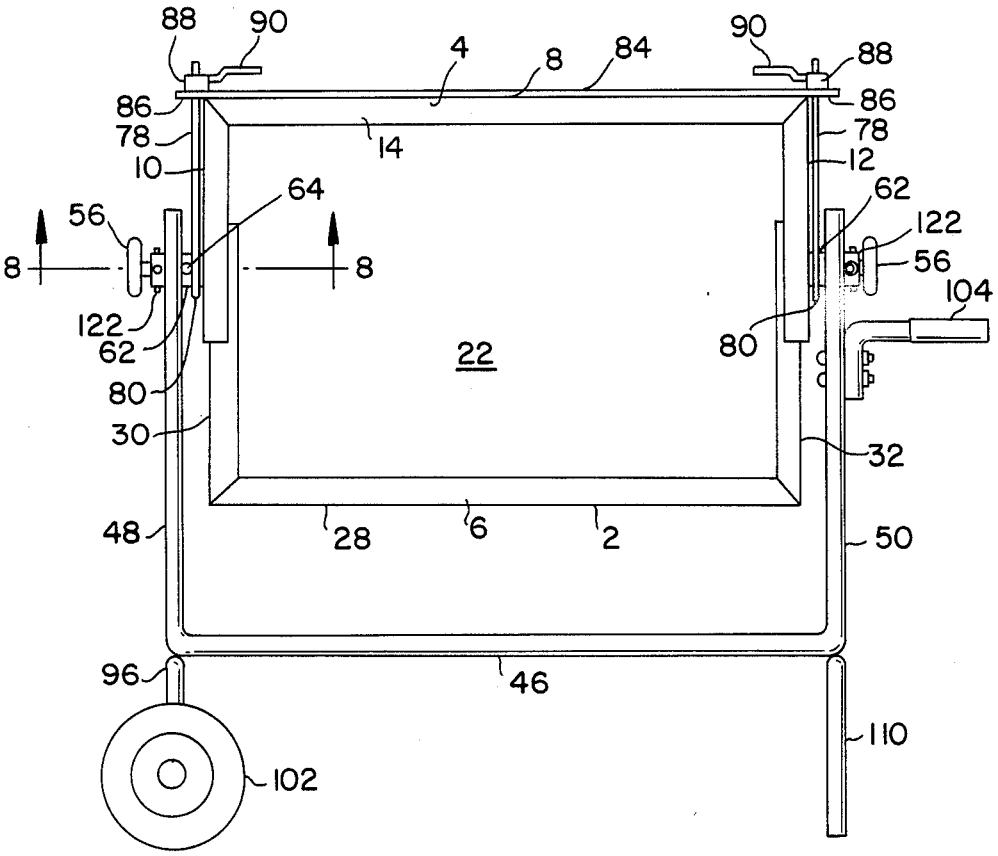
FIG. 5 is a side elevation view of an archery target in accordance with this invention with the cardboard strips removed.
Figure 6:
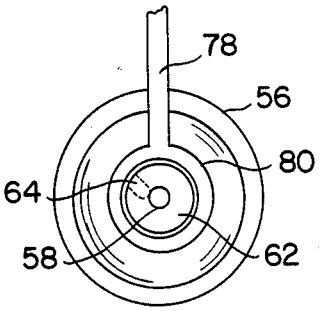
FIG. 6 is an end view of the pivot member used in the archery target in accordance with this invention, looking outwardly from its inner end toward its outer hand wheel.
Figure 7:
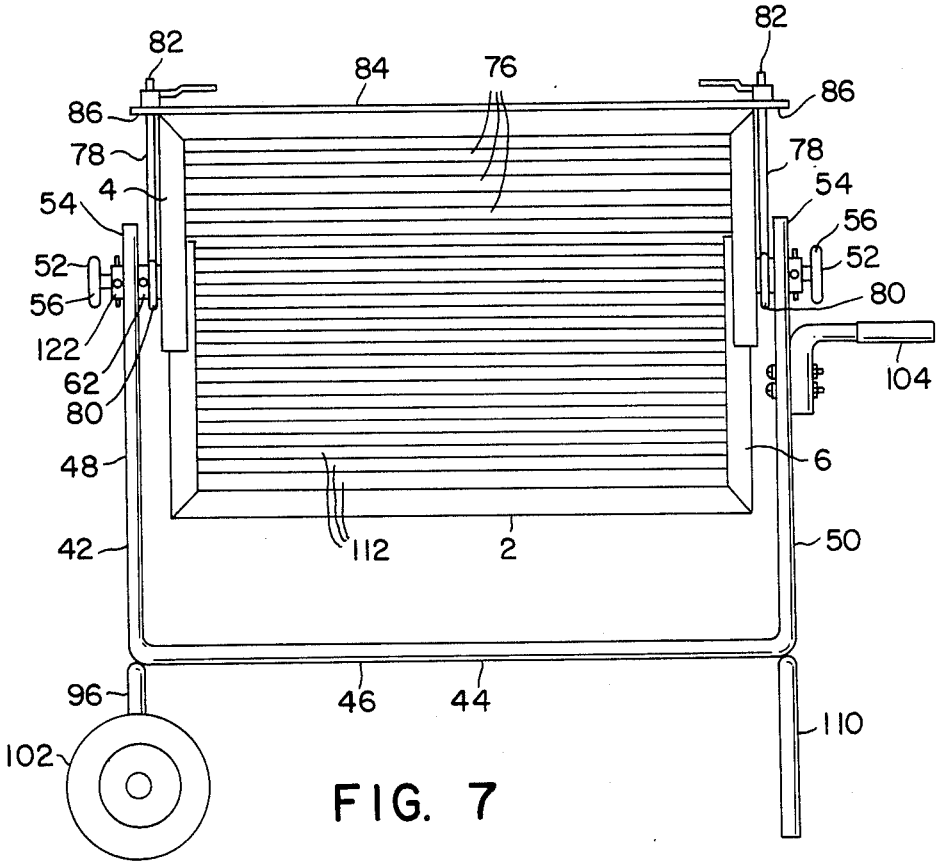
FIG. 7 is a side elevation view of an archery target as shown in FIG. 5 with the cardboard strips shown in place.
Figure 8:
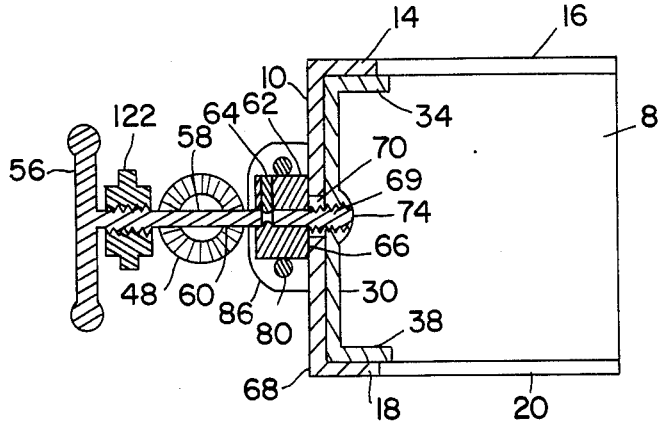
FIG. 8 is a section view taken on line 8—8 of FIG. 5.
Figure 9:
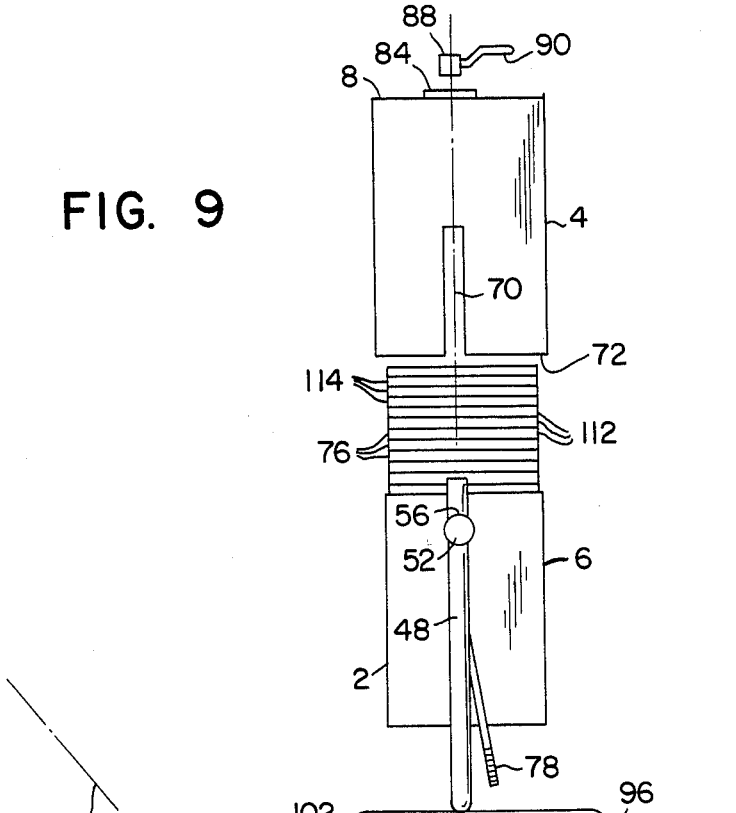
FIG. 9 is an exploded end elevation view illustrating the upper frame section in line above the lower frame section and a stack of cardboard strips ready to be lowered in place thereon.
Figure 10:
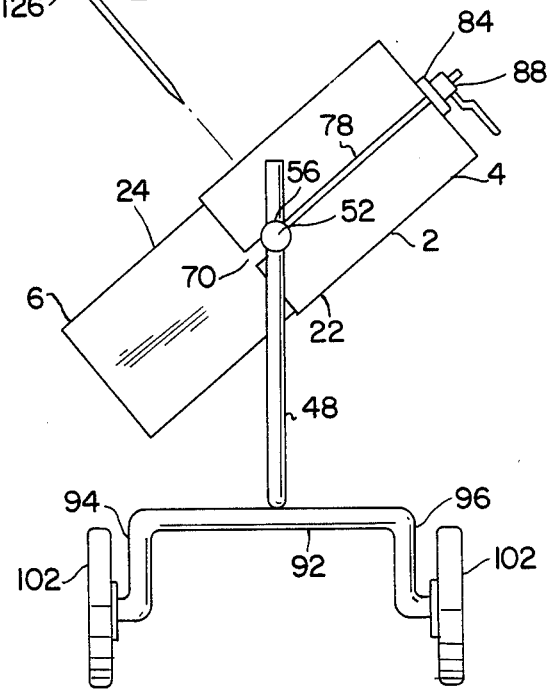
FIG. 10 is a side elevation view of an archery target in accordance with this invnetion shown at an obilque angle to the vertical end with its target impact face positioned normal to the flight path of an arrow shot from an above ground level position.

An archery target in accordance with this invention includes a rectangular peripheral frame 2 having an upper frame section 4 and a lower frame section 6 which telescopes into the upper frame section 4.

The upper frame section 4 has an inverted U-shaped configuration comprising a planar top wall 8 and a pair of planar end walls 10 and 12 depending from opposite ends thereof. A retaining flange 14 extends around the front edge 16 of the top and end walls of upper frame section 4 in a plane normal to the planar surfaces of said top wall 8 and end walls 10 and 12. A retaining flange 18 extends around the back edge 20 of the top and end walls of upper frame section 4 in a plane normal to the planarsurfaces of said top wall 8 and end walls 10 and 12. The retaining flange 14 and 18 of the upper frame section 4 border and define the respective upper portions of the spaced apart open side walls 22 and 24 of the peripheral frame 2.

The lower frame section 6 has a U-shaped configuration, comprising a planar bottom wall 28 and a pair of planar end walls 30 and 32 extending upwardly from opposite ends thereof. A retaining flange 34 extends around the front edge 36 of the bottom and end walls of lower frame section 6 in a plane that is normal to the planar surfaces of said bottom wall 28 and end walls 30 and 32. A retaining flange 38 extends around the back edge 40 of the bottom and end walls of lower frame section 6 in a plane normal to the planar surfaces of said bottom wall 28 and end walls 30 and 32. The retaining flanges 34 and 38 of the lower frame section 6 border and define the respective lower portions of the spaced apart side walls 22 and 24 of the peripheral frame 2.

The top wall 8 is slightly longer between its end walls 10 and 12 than bottom wall 28 between its end walls 30 and 32. The end walls 10 and 12 of the upper frame section 4 receive end walls 30 and 32 of the lower frame section 6 therebetween, end wall 10 being in sliding relationship with end wall 30 and outwardly thereof, end wall 12 being in sliding relationship with end wall 32 and outwardly thereof.

The top wall 8 is also slightly wider between its peripheral retaining flanges 14 and 18 than bottom wall 28 between its peripheral retaining flanges 34 and 38. The spaced apart retaining flanges 14 and 18 along the opposite edges of end walls 10 and 12 of the upper frame section 4 receive the retaining flanges 34 and 38 along opposite edges of end walls 30 and 32 of the lower frame section 6 therebetween, retaining flange 14 along the front edges of end walls 10 and 12 being in sliding relationship with retaining flange 34 along the front edges of end walls 30 and 32 and outwardly thereof, retaining flange 18 along the rear edges of end walls 10 and 12 being in sliding relationship with retaining flange 38 along the rear edges of end walls 30 and 32 and outwardly thereof.

The lower frame section 6 is pivotally supported on a stand 42 having a U-shaped tubular support member 44 comprising an elongated laterally extending tubular bar 46 and tubular support bars 48 and 50 which extend upwardly from each opposite end of the laterally extending bar 46.

A pivot member 52 is pivotally mounted near the upper end 54 of the upwardly extending support bars 48 and 50 for connection to upper portions of respective end walls 30 and 32 of the lower frame section 6. Each pivot member 52 includes a hand wheel 56, a central shaft 58 extending inwardly through aperture 60 of support bars 48 and 50, an annular bearing 62 secured to the shaft 58 by set screw 64 having a bearing surface 66 in facing and bearing relationship with the outer surface 68 of respective ones of end walls 10 and 12 of the upper frame section 4 when the frame 2 is assembled with respective end walls 30 and 32 of the lower frame section 6 received therebetween. A portion of shaft 58 of pivot member 52 extends inwardly of the annular bearing 62 comprising threaded shaft portion 69, through an upwardly extending recess 70 in outer end walls 10 and 12 of upper frame section 4 which opens to their bottom edges 72, the threaded shaft portion being threadedly received in the threaded tap 74 provided through the upper portions of respesctive end walls 30 and 32 of the lower frame section 6.

The upwardly extending recesses 70 along end walls 10 and 12 of the upper frame section 4 enable the upper frame section to be raised and lowered relative to lower frame section 6, whereby upper frame section 4 and its top wall 8 can be pressed downwardly against a stack of cardboard strips 76 laid one on top of the other on the bottom wall 28 of the lower frame section 6, thereby compressing the cardboard strips 76 together.

Compression adjustment means are provided to increase or decrease the compression of the cardboard strips 76, including an elongated adjustment rod 78 extending upwardly from a ring portion 80 around annular bearing 62 at one end to a threaded free end portion 82 which terminates at a point above the surface of top wall 8 of upper frame section 4 when in place with lower frame section 6 to form the assembled peripheral frame 2. A clamp bar 84 extends across top wall 8 having overhang portions 86 with apertures therein to receive the threaded free end portion 82 of respective adjustment rods 78 therethrough. A hand nut 88 having a hand grasp extension 90 is threaded on each adjustment rod 78 in bearing engagement against the clamp bar 84 to force it downwardly when tightened thereby increasing the downward pressure of top wall 8 against the cardboard strips 76 to increase compression for less penetration of an arrow therebetween. When the hand nuts 88 are loosened, top wall 8 is free to move upwardly enough to lessen the compression of the cardboard strips 76 against each other thereby permitting greater penetration of an arrow into the target and between the strips.

The tubular support member 44 of stand 42 is mounted on a tubular cross bar assembly 92 having depending legs 94 and 96 terminating at outwardly projecting axles 98 and 100 on which wheels 102 are rotatably received. The stand 42 and frame 2 with cardboard strips 76 therein which comprise the archery target in accordance with this invention can thus be easily rolled or wheeled to any desired location. A handle 104 is bolted to an upper portion of tubular support bar 50 for a user to grasp to pull the wheel mounted target. The cross bar assembly 92 is secured to and crosswise of the laterally extending tubular bar 46 of the tubular support member 44 at its end from which tubular support bar 48 extends upwardly.

A second tubular cross bar assembly 106 having spaced apart depending legs 108 and 110 is provided at the opposite end of the laterally extending tubular bar 46, and crosswise thereof, to rest on the ground or floor. The tubular cross bar assemblies 92 and 106 thereby support the laterally extending tubular bar 46 and stand 42 in a substantially horizontal position when at rest on the ground or floor.

The length of the bottom wall 28 of lower frame section 6 between its respective end walls 30 and 32 may be any appropriate dimension for an archery target, such as three or four feet, to provide open side walls 22 and 24 between the end walls of such dimension horizontally. The end walls 30 and 32 of lower frame section 6 extend upwardly from the bottom wall 28 an appropriate distance which may be approximately two feet. The outwardly overlapping end walls 10 and 12 of the upper frame section 4 have a similar length extending downwardly from the top wall 8, whereby the vertical dimension between top wall 8 and bottom wall 28 may be approximately three and a half to four feet, and adjustable between such dimensions.

The width of the bottom wall 28 of lower frame section 6 between its respective retaining flanges 34 and 38 is whatever dimension will be appropriate for the kind of bows and arrows used. An appropriate width is between twelve and eighteen inches.

In a typical embodiment of this invention, the cardboards strips 76 may therefore be about three to four feet in length and about twelve to as much as eighteen inches in width. The top, bottom and end walls provide an assembled peripheral frame 2 which has an ordinary rectangular configuration. The cardboard strips 76 to lay in such frame 2 on bottom wall 28 in stacked one-on-top-of-the-other relationship may therefore be cut into ordinary rectangular shapes with straight side edges 112 and 114 and straight end edges 116 and 118.

Each wall 8, 10, 12, 28, 30 and 32 have substantially parallel and straight side edges and end edges, each being of rectangular peripheral configuration.

To assemble the target in accordance with this invention for use, the upper frame section 4 is removed from lower frame section 6, and a plurality of rectangular cardboard strips 76 of corresponding dimension are stacked on the bottom wall 28 until the stack reaches a height substantially equal to the combined length of the end walls of the upper frame section 4 and lower frame section 6. The upper frame section 4 is then placed over the stack with it's depending end walls 10 and 12 in line to slide outside of the upwardly extending end walls 30 and 32 respectively of the lower frame section 6, the top wall 8 of upper frame section 4 coming to rest on the flat side 120 of the top cardboard strip in the stack.

The adjustment rods 78 are received through the apertures of clamp bar 84 and hand nuts 88 tightened thereon to press the top wall 8 against the stack of cardboard strips 76 until the desired degree of compression is obtained. The hand wheels 56 of each pivot member 52 are then rotated in the tightening direction to draw annular bearings 62 against end walls 10 and 12 of upper frame section 4 forcing them tightly against the overlapped portions of end walls 30 and 32 of lower frame section 6, thereby holding frame sections 4 and 6 against relative movement until the pivot members 52 are loosened. The side edge 112 of cardboard strips 76 are thus exposed as a target impact surface through open side wall 22 and side edges 114 of the cardboard strips are exposed as a target impact surface through open side wall 24 of the peripheral frame 2.

The assembled frame 2 is held in fixed position on the stand 42 by tightening lock nuts 122 threaded on shaft 58 against the upwardly extending tubular support bars 48 and 50 of the stand 42, until they are tightly sandwiched between the lock nuts 122 on the outboard side and the annular bearing 62 on the inboard side.

The frame 2 may be rotated on pivot members 52 through the entire 360 degree radius and locked in position at any point thereof. Thus, if an archer assumes a position in a tree or on a ledge some distance above ground level, the frame 2 may be rotated on pivot members 52 until the planes of open side walls 22 and 24 are normal to the flight path 124 of an arrow 126 shot from such above ground level position, whereupon lock nuts 122 may be tightened to hold the frame 2 in such position with open side walls 22 and 24 at an oblique angle to the vertical, presenting the compressed together side edges 112 or 114 of the cardboard strips 76 as a target depending on whether the frame 2 has been rotated to present open side wall 22 or 24 in the direction facing the archer.

Since frame 2 may be rotated completely through the entire 360 degrees of a circle, when side edges 112 of cardboard strips 76 presented through open side wall 22 become worn from excessive use, the frame 2 may be rotated to position the opposite open side wall 24 in the direction facing the archers thereby presenting the previously unused fresh side edges 114 of cardboard strips 76 as the impact surface of the target.

When the cardboard strips 76 in the center portion of the target frame 2 become excessively worn along both side edges 112 and 114, the upper frame section 4 may be removed and the cardboard strips 76 rearranged by putting those previously near the top and bottom in the center and those previously in the center at the top and bottom locations.

After all of the strips have been excessively worn on both sides, new cardboard strips 76 can be made from any available throw away cardboard cartons of appropriate size by merely slicing into rectangles of the size required by the dimensions of the frame being used.

The strips 76 may be made of other material which are porous, fibrous compressible, or otherwise penetratable by an arrow into a side edge thereof or between two of such strips compressed together. Materials which have corrugations or other celluar like openings along the exposed side edges of a strip of such material are particularly appropriate for use in accordance with this invention. The top and bottom surfaces of the strips 76 may be completely flat and smooth. The strips 76 are long enough to extend from end walls 10, 30 at one end to 12, 32 at the other end whereby the ends 116 and 118 of the strips 76 lie behind and between the peripheral flanges 34, 38 of lower frame section 6 and peripheral flanges 14, 18 of upper frame section 4. The peripheral flanges thus retain the strips 76 within the frame 2 and prevent them from projecting outwardly through the open side walls 22 and 24.

I claim:

1. An archery target for arrows, comprising a frame having peripheral wall means defining an outwardly and upwardly facing surface, an outwardly and downwardly facing surface, a first laterally facing surface facing outwardly in a first lateral direction and a second laterally facing surface facing outwardly and oppositely in a second lateral direction, said peripheral wall means defining and bordering a loading space therebetween, said peripheral wall means having a first peripheral edge facing forwardly bordering a first open side wall, and a second peripheral edge spaced apart therefrom rearwardly facing rearwardly bordering a spaced apart second open side wall, a plurality of separated quadrilateral strips having flat planar surfaces stacked in said loading space of said frame with the flat planar surfaces of adjacent strips in facing bearing relationship one to the other respectively, said quadrilateral strips having a pair of spaced apart relatively long side edges comprising first and second side edges terminating at one end in a first relatively short end edge and at the opposite end in a second relatively short end edge, said side edges and end edges being straight throughout, said first side edges of said quadrilateral strips facing forwardly in the direction faced by said first peripheral edge of said frame, said second side edges of said quadrilateral strips facing rearwardly in the direction faced by said second peripheral edge of said frame, a plurality of said first side edges facing through said first open side wall, a plurality of said second side edges facing through said second open side wall, said flat quadrilateral strips being of porous material, and retaining means to retain said plurality of separate quadrilateral strips within said frame and from projecting outwardly of said first and second open side walls thereof when penetrated by arrows aimed at said target, wherein said peripheral walls means includes an upper frame member and a lower frame member supported for reciprocal movement of said upper frame member in a direction downwardly toward and upwardly away from said lower frame member, said upper frame member including a bearing portion positioned to face said quadrilateral strips in said stack and to bear downwardly thereagainst, and compression means connected to hold said bearing portion of said upper frame member in compressing relationship downwardly against said stack of quadrilateral strips, wherein said compression means includes at least one threaded shank connected between said upper frame member and said lower frame member and a nut threaded thereon to press said upper frame member in the direction toward said lower frame member and against said stack of quadrilateral strips when rotated in one direction of rotation, said threaded shank being positioned outwardly of said side and end edges of said quadrilateral strips.

2. An archery target for arrows comprising a frame having peripheral wall means defining an outwardly and upwardly facing surface, an outwardly and downwardly facing surface, a first laterally facing surface facing outwardly in a first lateral direction and a second laterally facing surface facing outwardly and oppositely in a second lateral direction, said peripheral wall means defining and bordering a loading space therebetween, said peripheral wall means having a first peripheral edge facing forwardly bordering a first open side wall, and a second peripheral edge spaced apart therefrom rearwardly facing rearwardly bordering a spaced apart second open side wall, a plurality of separated quadrilateral strips having flat planar surfaces stackd in said loading space of said frame with the flat planar surfaces of adjacent strips in facing bearing relationship one to the other respectively, said quadrilateral strips having a pair of spaced apart relatively long side edges comprising first and second side edges terminating at one end in a first relatively short end edge and at the opposite end in a second relatively short end edge, said side edges and end edges being straight throughout, said first side edges of said quadrilateral strips facing forwardly in the direction faced by said first peripheral edge of said frame, said second side edges of said quadrilateral strips facing rearwardly in the direction faced by said second peripheral edge of said frame, a plurality of said first side edges facing through said first open side wall, a plurality of said second side edges facing through said second open side wall, said flat quadrilateral strips being of a porous material, and retaining means to retain said plurality of separate quadrilateral strips within said frame and from projecting outwardly of said first and second open side walls thereof when penetrated by arrows aimed at said target, wherein said peripheral walls means includes an upper frame member and a lower frame member supported for reciprocal movement of said upper frame member in a direction downwardly toward and upwardly away from said lower frame member, said upper frame member including a bearing portion positioned to face said quadrilateral strips in said stack and to bear downwardly thereaginst, and compression means connected to hold said bearing portion of said upper frame member in compressing relationship downwardly against said stack of quadrilateral strips, wherein said upper frame member includes a laterally extending top wall terminating at one end in a first upper end wall extending therefrom and normal thereto and at the opposite end in a second upper end wall extending therefrom in substantially parallel facing relationship with said first upper end wall, said lower frame member includes a laterally extending bottom wall in substantially parallel facing relationship with said top wall when said upper frame member is in place relative to said lower frame member, said bottom wall terminating at one end in a first lower end wall extending therefrom and normal thereto and at the opposite end in a second lower end wall extending therefrom in substantially parallel facing relationship with said first lower end wall, one pair of said first and second upper end walls and said first and second lower end walls being spaced apart far enough to receive the other therebetween in sliding telescoping relationship when said upper frame member is in place relative to said lower frame member to comprise said peripheral wall means, said bearing portion of said upper frame member comprising said top wall thereof.

3. An archery target for arrows as set forth in claim 2, wherein said compression means to hold said bearing portion top wall of said upper frame member in compressing relationship downwardly against said stack of quadrilateral strips includes an elongated recess opening to the free end of each end wall of one pair of said first and second upper ends walls and said first and second lower end walls, and a connecting pin projecting from a corresponding facing portion of each end wall of the other pair of said end walls toward and through said receisses respectively, a bearing member on each of said connecting pins positioned to press the facing portion of said end wall of one of said pair of end walls against the adjacent portion of said end wall of the other of said pair of end walls respectively, and securing means on each of said connecting pins to press each of said bearing pins in said bearing engagement when secured on said connecting pins thereby holding said upper frame member against reciprocal movement relative to said lower frame member.

4. An archery target for arrows as set forth in claim 3, wherein said connecting pins are threaded bolts and said securing means includes an internally threaded member for threaded reception on said threaded bolt.

5. An archery target for arrows as set forth in claim 3, including wheel means connected to support and move said frame member.

* * * * *